US005289789A

United States Patent [19]

Sakuma

[11] Patent Number: 5,289,789

[45] Date of Patent: Mar. 1, 1994

[54] KNIFE DRIVE MECHANISM OF SEWING MACHINE

[75] Inventor: Kouichi Sakuma, Yamagata, Japan

[73] Assignee: Suzuki Manufacturing Co., Ltd., Japan

[21] Appl. No.: 906,857

[22] Filed: Jun. 30, 1992

[30] Foreign Application Priority Data

Jul. 15, 1991 [JP] Japan ..... 3-174008

[51] Int. Cl.[5] ..... D05B 37/06; D05B 69/02

[52] U.S. Cl. ..... 112/122; 112/220

[58] Field of Search ..... 112/125, 122, 122.1, 112/122.2, 122.3, 122.4, 129, 220; 83/902, 701, 936, 571

[56] References Cited

U.S. PATENT DOCUMENTS

| | | | |
|---|---|---|---|
| 1,426,466 | 8/1922 | DeVoe | 112/125 |
| 2,790,405 | 4/1957 | Graham | 112/122.1 |
| 3,074,363 | 1/1963 | Gross et al. | 112/125 |
| 4,285,290 | 8/1981 | Kaltenbach | 112/125 |

*Primary Examiner*—Clifford D. Crowder
*Assistant Examiner*—Paul C. Lewis
*Attorney, Agent, or Firm*—Lorusso & Loud

[57] ABSTRACT

A knife drive mechanism of a sewing machine includes a drive assembly 1 for converting rotary motion of a drive shaft 10 into a swing motion and an upper-knife drive assembly 2 for converting the swing motion into an up-and-down motion of an upper knife 20. The upper-knife drive assembly 2 has a clutch 3 for preventing/permitting transmission of the up-and-down motion to the knife 20. Even during stitching, engagement-/disengagement of the clutch 3 can be effected, which permits the knife 20 to be connected to and disconnected from its drive assembly, thereby permitting the scissoring cutting to be started or stopped. When a surface 42 of the first swing member 4 urges a projection 52 of a second swing member 5 to cause the knife 20 to move downward at the completion of cutting, the knife 20 itself serves as a cloth-feed guide to prevent misalignment of the cloth and breakage of the sewing needle or upper and lower loopers.

7 Claims, 6 Drawing Sheets

KNIFE DRIVE MECHANISM OF SEWING MACHINE

BACKGROUND OF THE INVENTION

1. Field of the Invention

The present invention relates to a knife drive mechanism of a sewing machine, and more particularly to a knife mechanism having an upper knife which may be selectively connected with or released from its drive means.

2. Description of the Prior Art

In an overlocking machine for sewing a raw edge of cloth, it is necessary to always keep a margin of cloth of a predetermined dimension between the raw edge and the line along the cloth penetrated by the sewing needle. Consequently, it is necessary to neatly cut the raw edge of the cloth immediately before sewing the cloth. For this purpose, in the sewing machine, a lower knife is fixedly mounted on a needle plate disposed in front of the position where the sewing needle penetrates the cloth; and an upper knife, which is so provided as to cooperate with the lower knife to perform a scissor-action.

The scissoring action performed between the upper and the lower knife must be stopped in the following cases: where the edge of the cloth is already cut prior to sewing the cloth; in sewing the last portion of a sleeve-like cloth, where the edges of the cloth are already cut because such last portion of the cloth is partially overlapped with an initially-stitched portion of the cloth; and where pin-tuck stitching is performed.

In a conventional knife drive mechanism of a sewing machine disclosed in Japanese Patent Laid-Open No. Sho 54-152550, which was filed by the applicant of the present invention, as shown in FIG. 7, in operation, an upper knife P moves past a needle plate upward only when cutting operation of the cloth is performed, so that the upper knife cooperates with a lower knife to perform scissoring action. On the other hand, when no cutting of the cloth is required, the upper knife P is held stationary in the bed Q. This prior art mechanism includes a lifting arm R, to which the upper knife P is fixed, and a drive arm S which pivots with arm R, whereby upper knife P moves up-and-down. The drive arm S and a drive lever T, which is driven by a main spindle through a crank motion, are connected to each other through a shaft U, to permit the shaft U to be connected to or disconnected from a connecting/disconnecting element V which is provided in the lifting arm R, whereby motion of the drive lever T is transmitted to the lifting arm R when the connecting/disconnecting element V is engaged with the shaft U. In this manner the lifting arm R moves past the machine bed Q upward together with the upper knife P to perform the scissoring action in cooperation with the lower knife; and, when a dial W is switched, the connecting/disconnecting element V is disengaged from the shaft U to permit the upper knife P to enter the bed Q where the knife P is stationarily received.

It is true that the conventional knife drive mechanism described above is advantageous in that: the upper knife moves past the needle plate upward only during cutting of the cloth; and the upper knife is held under the needle plate when no cutting of the cloth is required. However, in order to stop the scissoring action of the upper and the lower knives, it is necessary to stop the sewing machine, thereby permitting the shaft (on which the upper knife is mounted, the shaft being connected with the drive mechanism) to be axially moved, which interrupts the stitching operation of the machine.

Another conventional knife drive mechanism is disadvantageous in that it is too complicated in construction (see Japanese Utility Model Laid-Open No. Sho 51-16547).

Further, in the prior art, after the scissoring action is stopped, when a raw edge of the cloth extends from the needle plate, there is the danger that the raw edge will get caught by the upper looper to cause the breakage of the upper looper, a sewing needle, a lower looper or the like. Even when the scissoring action of the upper and the lower knives is stopped, in some cases, the upper knife continues its up-and-down motion spaced apart from the lower knife. Because of this, it is apparent that a need exists for preventing the raw edge of the cloth from extending from the throat plate.

SUMMARY OF THE INVENTION

It is an object of the present invention to solve the above problems by providing a knife drive mechanism for a sewing machine, in which an upper knife performs a guide function, and may be engaged with or disengaged from its drive means during stitching whereby scissoring action between the upper knife and a lower knife is stopped and started.

Another object of the present invention is to prevent the raw edge of the cloth from extending from a needle plate upon the stoppage of the scissoring action.

The above objects of the present invention are accomplished by providing, in a knife drive mechanism of a sewing machine, a first drive means for producing a swinging motion from a drive shaft; an upper-knife drive means for converting the swinging motion into an up-and-down motion for driving the upper knife; and, in the upper-knife drive means, a clutch for preventing/permitting the up-and-down motion to be transmitted to the upper knife.

The upper knife drive means includes a shaft pivotally mounted on a main frame of the machine; first and second swing members, the first swing member being provided with a horizontally swingable arm which is connected to the first drive means so as to be swung horizontally, the second swing member being provided with a vertically swingable arm which is connected with the upper knife and which is swung vertically; and a clutch interposed between the first and second swing members.

The second swing member has a projection abutting against a side surface of the first swing member, the side surface facing in the direction in which the first swing member swings. When the first swing member is swung to move the upper knife downward to effect cutting of the cloth, the side surface of the first swing member urges the projection of the second swing member, thereby transmitting a cutting force to the upper knife through the second swing member.

The clutch includes a clutch member which is connected to the second swing member and is movable between an engaged position in which the clutch member engages the first swing member and a disengaged position in which the clutch member is disengaged from the first swing member. An energizing means urges the clutch means to the engaged position. An upper-knife releasing lever is provided for moving the clutch member to the disengaged position against the action of the energizing means. The upper-knife drive means includes an upper-knife mounting shaft to which is fixed the upper knife and which is slidably supported by the second swing member. Means is provided for turning the upper-knife mounting shaft so as to forcibly move the upper knife toward the lower knife for cutting the cloth.

Further, the upper-knife drive means is provided with an upper-knife limit means for limiting travel of the upper knife. The upper-knife limit means includes a first guide member having an elongated hole which extends vertically, the first guide member being fixed to the main frame of the machine; and a second guide member which carries a pin which projects therefrom, the pin having one of its ends fixed to the upper knife and its other end riding within the elongated hole of the first guide member.

According to the present invention, it is possible to move the first clutch member to the disengaged position by operating the upper-knife releasing lever. Such operation of the upper-knife releasing lever can be effected while the first swing member is in motion. When the upper knife reaches its lowest position, the up-and-down motion of the upper knife is stopped so that the upper knife is released from its drive means. Consequently, it is possible to stop the scissoring action between the upper and lower knives, even while the stitching operation continues. In addition, since the upper knife may be stopped at its lowest position without fail, it is possible, by proper setting of the upper-knife limit means, to have the upper knife perform a guide function.

BRIEF DESCRIPTION OF THE DRAWINGS

FIGS. 4(*a*) and 4(*b*) are side views illustrating, in action, the clutch means and the upper-knife releasing lever of the knife drive mechanism of the sewing machine of the present invention, in which: FIG. 4(*a*) shows the operative state of the upper knife; and FIG. 4(*b*) shows the upper knife released;

DESCRIPTION OF THE PREFERRED EMBODIMENTS

Hereinbelow, the present invention will be describe in detail with reference to the accompanying drawings illustrating embodiments of a knife drive mechanism of a sewing machine according to the present invention.

Figure 1:
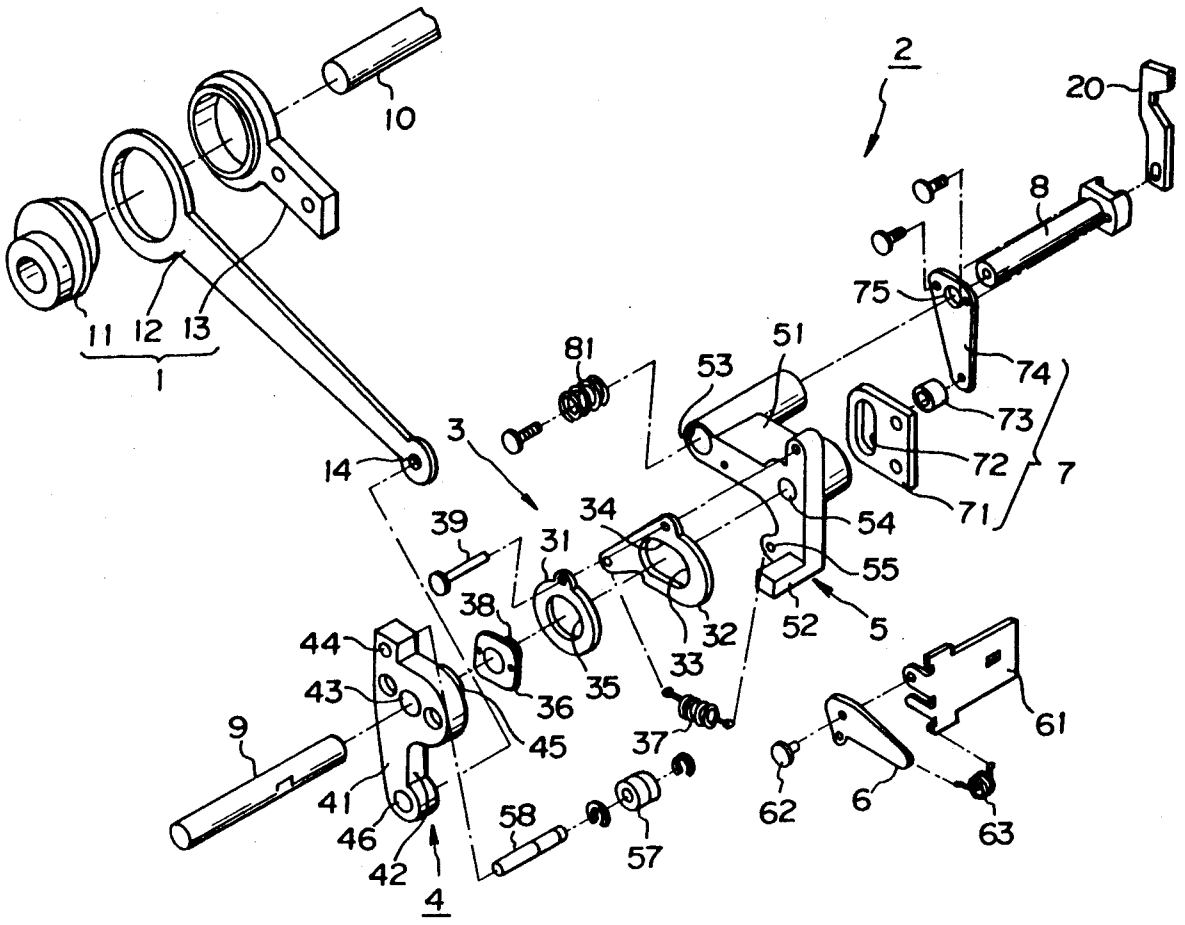
FIG. 1 is an exploded perspective view of an embodiment of the knife drive mechanism of the sewing machine of the present invention.

As shown in FIG. 1, a knife drive mechanism of the present invention is provided with: a drive means 1 including a knife drive rod 12 to which a swinging motion is imparted by a drive shaft 10; and an upper-knife drive means 2 which converts the swinging motion of the drive means 1 into an up-and-down motion and transmits the same to an upper knife 20. The upper-knife drive means 2 is provided with a clutch means 3 for preventing/permitting the up-and-down motion transmission to the upper knife.

Figure 2:
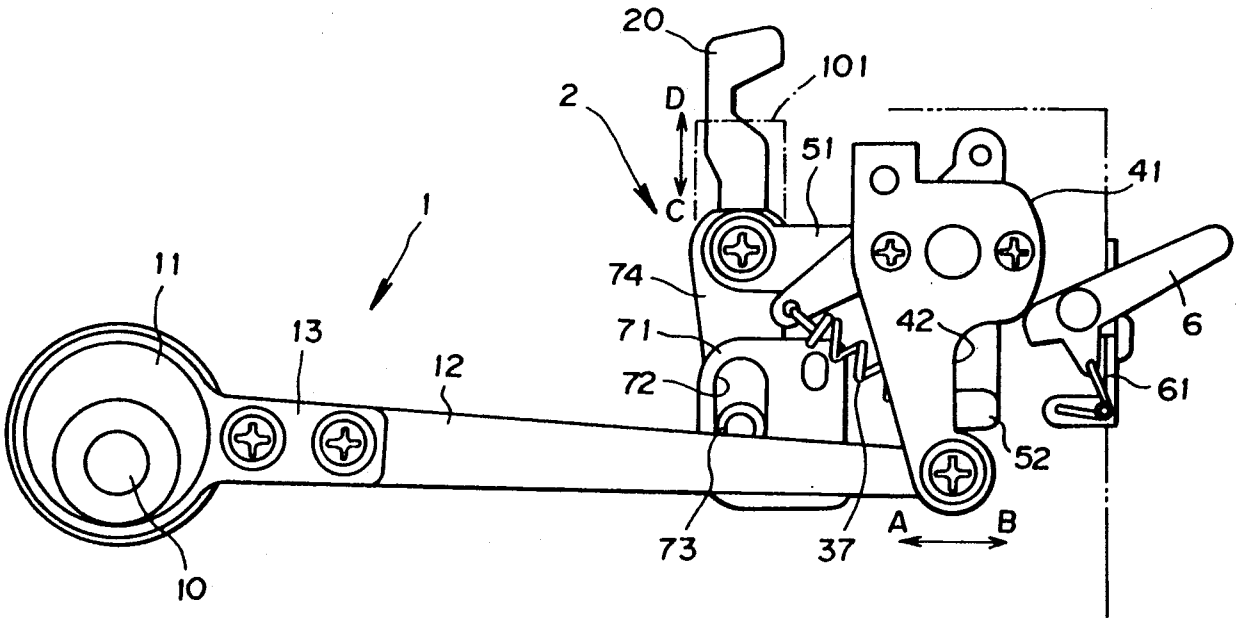
FIG. 2 is a side view of the embodiment of FIG. 1.

As shown in FIG. 2, the drive means 1 includes: an eccentric cam 11 fixedly mounted on the drive shaft 10; a knife drive rod 12 having one of its ends engaged with the eccentric cam 11 inserted therein and the other of its ends connected to the upper-knife drive means 2, which rod 12 acts as a horizontal drive rod. A rod mounting base 13 serves to mount the horizontal drive rod 12 on the eccentric cam 11.

As shown in FIG. 1, the upper-knife drive means 2 includes: a knife swinging arm shaft 9 which is a shaft pivotally mounted on a main frame 100 (see FIG. 3) of the sewing machine; and a first swing member 4 and a second swing member 5, both of which are swingably mounted on the knife swinging arm shaft 9.

The first swing member 4 has a horizontal swing arm 41 connected to the knife drive rod 12 which converts rotary motion of the drive shaft 10 into a horizontally swinging motion through the eccentric cam 11. A side surface 42 of the first swing member 4 is in a position slightly above a lower end portion of the member 4 and defines a front area of the member 4. Side surface 42 faces the direction in which the lower end portion of the member 4 swings horizontally, the lower end portion being connected to the knife drive rod 12. Mounted on the first swing member 4 are a feed lifting roller 57 and a feed lifting roller shaft 58 which form a mechanism for generating the up-and-down motion required for cloth feed. A second swing member 5 has a vertically swinging arm 51 which is connected with an upper knife 20 to effect an up-and-down motion. In addition, the second swing member 5 is provided with a projection 52 which extends leftward as viewed in FIG. 1 to abut against the side surface 42 of the first swing member 4 as is clear from FIG. 2. As shown in FIG. 2, in operation, when the side surface 42 of the first swing member 4 swings in direction B of double arrow AB, the projection 52 of the second swing member 5 is horizontally pushed to the right (as viewed in FIG. 2) by the side surface 42 to cause the vertically swinging arm 51 of the second swing member 5 to move downward, so that the upper knife 20 is moved downward in direction C of the double arrow CD through the second swing member 5, whereby the upper knife 20 cooperates with a lower knife 101 to effect a scissoring action therebetween, through which action the cloth being stitched is cut. Interposed between the first swing member 4 and the second swing member 5 is a clutch means 3.

Figure 3:
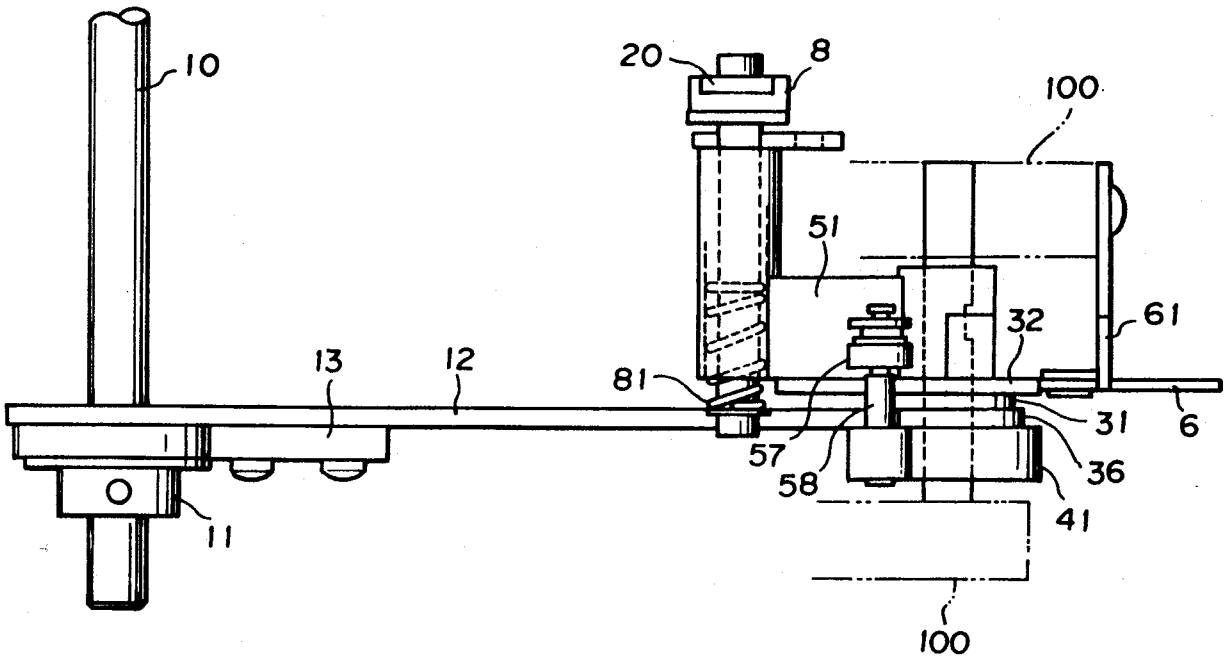
FIG. 3 is a plan view of the embodiment of FIG. 1.

As is clear from FIG. 1, the upper knife 20 is fixedly mounted on an upper-knife mounting shaft 8. The shaft 8 passes through a hole 75 of an upper-knife guide arm 74 (which will be described later), supports a spring 81 on its peripheral surface, and is slidable mounted in a hole 53 of the second swing member 5. As shown in FIGS. 2 and 3, the spring 81 is a means for urging the upper-knife mounting shaft 8 to rotate the upper knife 20 toward the lower knife 101 which is positioned to effect cutting of the cloth.

Figures 6A, 6B:
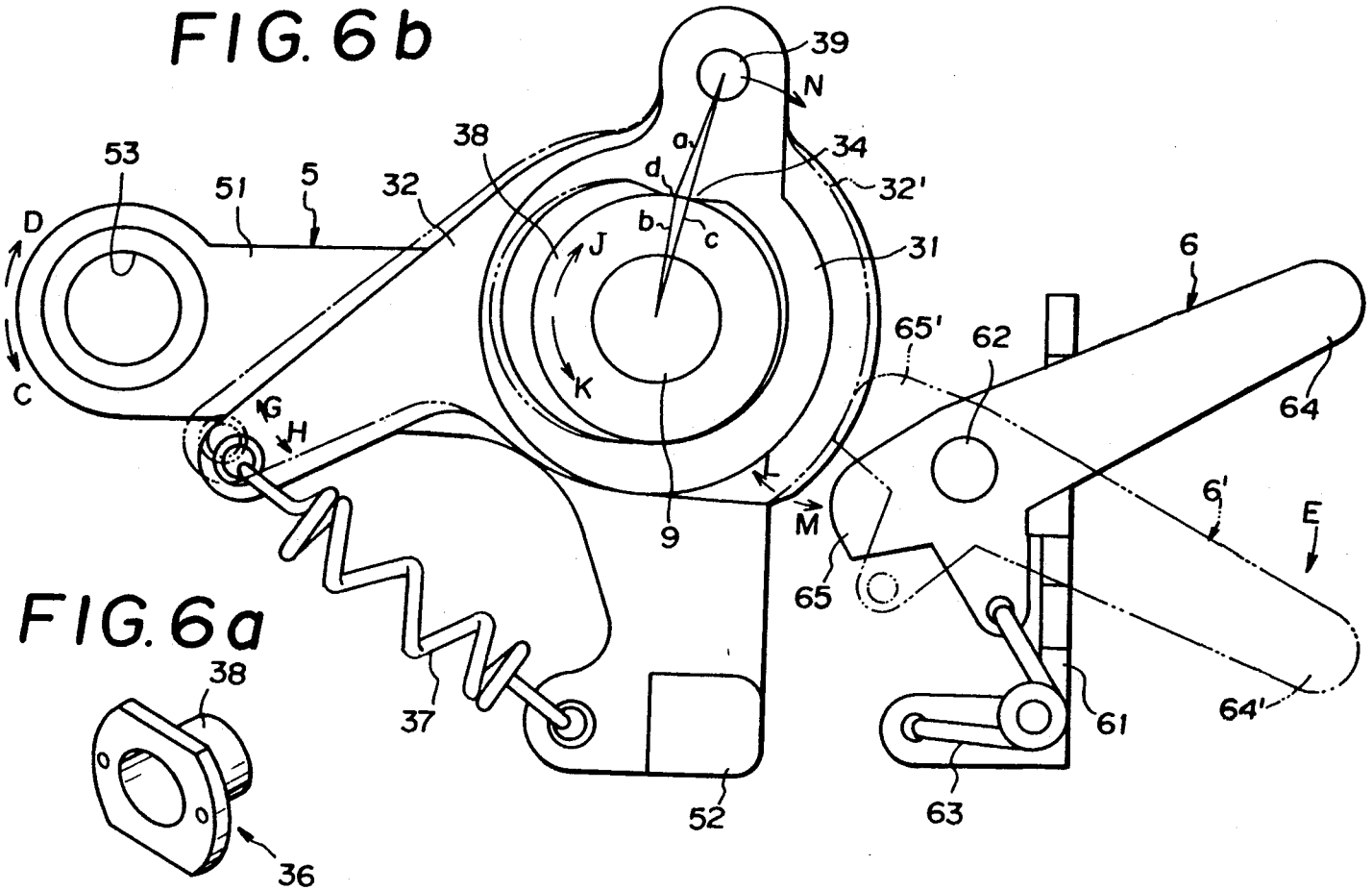
FIGS. 6(*a*) and 6(*b*) are detailed views of the clutch used in the knife drive mechanism of the present invention.
Figure 7:
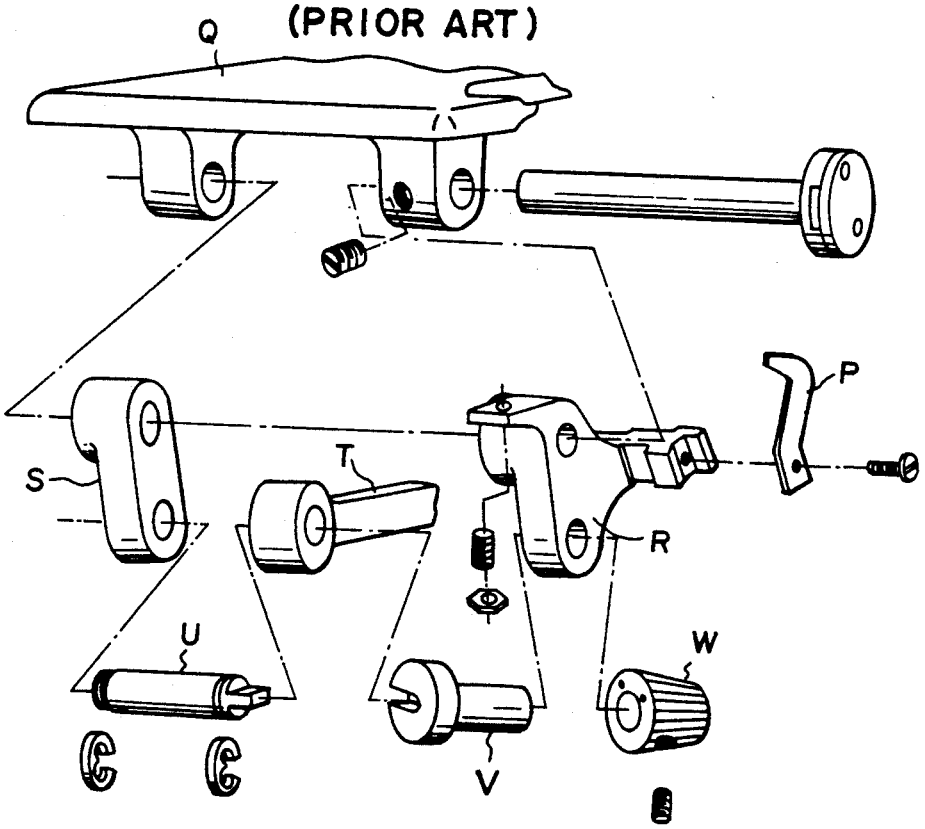
FIG. 7 (PRIOR ART)
FIG. 7 is an exploded perspective view of essential parts of the conventional knife drive mechanism of a sewing machine.

As shown in FIG. 1, the clutch 3 includes a second clutch member 36 (shown in FIG. 6(*a*)) provided with a boss portion 38 and a first clutch member 32 provided with a convex portion 34 and a horizontal slightly elongated hole 33. The convex portion 34 presses against the periphery of the boss portion 38 of the second clutch member 36. A third clutch member 31 is provided with a substantially circular hole 35 in which the outer peripheral surface of the boss portion 38 of the second clutch member 36 is loosely fitted. A clutch-member energizing spring 37 acts as an energizing means for pulling the first clutch member 32 to its engaged position where it engages the first swing member 4. An upper-knife releasing lever 6 is provided for moving the first clutch member 32 to a disengaged position against the action of the spring 37.

The second clutch member 36 is fixed to the first swing member 4. The boss portion 38 of the second clutch member 36 forms an essential part of the clutch means 3, and has a center bore into which a knife swinging arm shaft 9, passing through a working portion 43 of the horizontal swing arm 41, is inserted. The third clutch member 31 and the first clutch member 32 are mounted on the vertically swinging arm 51 through a pin 39, and also mounted on an outer peripheral surface of the boss portion 38 of the second clutch member 36 side by side in this order. The third clutch member 31 prevents misalignment of the first clutch member 32 to ensure that the convex portion 34 of the member 32 is pressed against the boss portion 38 of the second clutch member 36.

The clutch-member energizing spring 37 has one of its ends mounted in a base portion 55 (adjacent to the projection 52) of the second swing member 5 and its other end mounted in an end portion of the first clutch member 32, the end portion being in a rear area in which the drive shaft 10 is disposed as shown in FIG. 1. In this manner the spring 37 presses the convex portion 34 of the first clutch member 32 against the outer peripheral surface of the boss portion 38 of the second clutch member 36, with the convex portion 34 slightly projecting inside the hole 33 of the first clutch member 32.

The upper-knife releasing lever 6 is mounted on an upper-knife releasing lever mount 61 through a screw 62 and an upper-knife releasing lever spring 63, the mount 61 being fixed to the main frame 100 of the sewing machine. In operation, when an end portion 64 of the upper-knife releasing lever 6 is moved downward to a position 64' which is shown in FIG. 6(*b*) by a phantom line, the end portion 64 is maintained in this position 64' by the action of the spring 63.

Figure 4A:
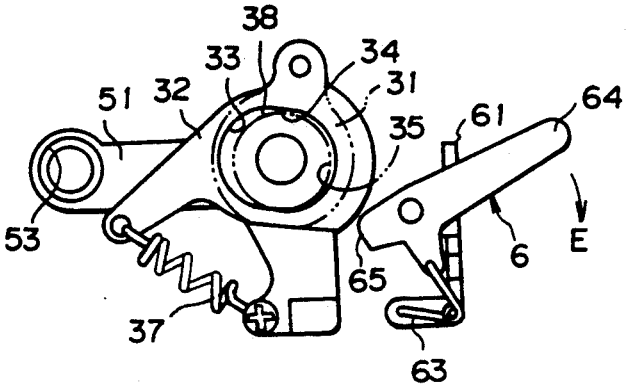
Figure 4B:
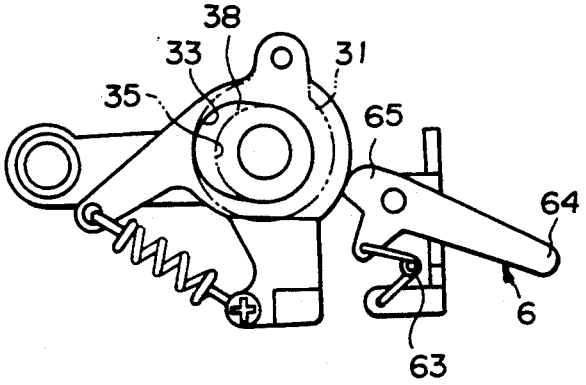
Figure 5:
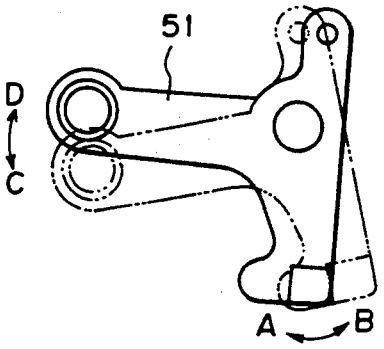
FIG. 5 is a side view illustrating the operation of the vertically swinging arm of the knife drive mechanism.

As shown in FIGS. 4(*a*) and 6(*b*), when the upper knife 20 is operated, end 64 of the upper-knife releasing lever 6 is separated from the first clutch member 32. Since the spring 63 tends to expand outwardly, the spring 63 moves the end portion 64 of the upper-knife releasing lever 6 in the direction of arrow E, as shown in FIG. 4(*a*). As a result, the end 65 of the upper-knife releasing lever 6 pushes the first clutch member 32 against the action of the clutch-member energizing spring 37. When the upper knife 20 is operated, the outer peripheral surface of the boss portion 38 of the second clutch member 36 is released from the convex portion 34 of the first clutch member 32.

When the outer peripheral surface of the boss portion 38 is released from the convex portion 34 of the first clutch member 32, even when a swing motion is transmitted by the first drive means 1, to the first swing member 4 motion of the second clutch member 36 fixed to the horizontal swing arm 41 is not transmitted to the third clutch member 31 or the first clutch member 32. Consequently, the upper knife 20 stops its motion. Release of the clutch means 3 by means of the upper-knife releasing lever 6 can be effected even when the drive shaft 10 is rotated, i.e., even during stitching of the cloth. Of course, the clutch means 3 can also be released when the drive shaft 10 is at rest.

As shown in FIGS. 1, 2 and 3, the upper-knife drive means 2 is provided with an upper-knife positioning means 7 for determining a releasing position of the upper knife 20. The upper-knife positioning means 7 comprises: an upper-knife guide plate 71 fixedly mounted on the main frame 100 of the sewing machine, which plate 71 serves as a guide member provided with a vertically elongated hole 72; and an upper-knife guide arm 74 which has its one end fixed to the upper-knife mounting shaft 8. A pin 73 is mounted on the arm 74 and extends into the elongated hole 72 of the guide plate 71. The upper-knife positioning means 7 functions to guide the upper knife 20, and confines movement of the knife 20 to substantially linear motion vertically in a predetermined limited range.

Since the pin 73 carried by the upper-knife guide arm 74 slidably moves within the limits of the vertically elongated hole 72 of the upper-knife guide plate 71, the pin 73 determines a lower limit for motion of the upper knife 20. Of course, the lower limit of the upper knife 20 motion also depends on the swinging motion of the drive means 1 which swingably moves the first swing member 4. By setting the lower limit for motion of the upper knife 20, it is possible to use the upper knife 20 itself as a guide for feeding the cloth, so that misalignment in cloth feed and breakages of the sewing needle and loopers are prevented. In addition, it is preferable to place the upper knife 20 under the needle plate to effect double-chain stitching.

Because the upper knife 20 is fixed to the upper-knife mounting shaft 8, the upper-knife guide arm 74 is fixed to the upper-knife mounting shaft 8 in the vicinity of the upper knife 20 and the pin 73 of the knife guide arm 74 is slidably mounted in the vertically elongated hole 72 of the upper-guide plate 71, the arcuate up-and-down motion (motion indicated by double arrow CD effected by the vertically swinging arm 51) becomes close to a linear up-and-down motion.

Now, the relation between the clutch members and their functions will be described with reference to FIGS. 6(*a*) and 6(*b*).

When the upper-knife releasing lever 6 is not abutted against the first clutch member 32, the first clutch member 32 is pulled in a direction H by means of the spring 37, with the pin 39 acting as a fulcrum or supporting point of the first clutch member 32. Under the influence of a tensile force exerted by the action of the spring 37, the convex portion 34 of the first clutch member 32 is pressed against the outer peripheral surface of the boss portion 38 of the second clutch member 36 at a position d as shown in FIG. 6(*a*). In this condition, when the boss portion 38 of the second clutch member 36 rotates in a direction J, the convex portion 34 is pulled so as to catch the outer peripheral surface of the boss portion 38 of the second clutch member 36.

The above is expressed in equation as follows:

$$a+b>c$$

where a is a radial distance between the center of the pin 39 and the peak of the convex portion 34, b is the radius of the boss portion 38 of the second clutch member 36, and c is the distance from the center of the pin 39 to the center of the knife swinging arm shaft 9.

In the above condition, when the boss portion 38 of the second clutch member 36 turns in the direction J, the sum of a and b approaches the value of c to cause the convex portion 34 to catch the outer peripheral surface of the boss portion 38 at the position d.

When the catching force exerted by the convex portion 34 at the position d reaches its maximum value, the third clutch member 31, first clutch member 32 and the second clutch member 36 are integrated in action to turn the pin 39 in a direction N, so that the vertically swinging arm 51 turns about the knife swinging arm shaft 9 in the direction D, whereby the upper knife 20, which is fixedly mounted on the upper-knife mounting shaft 8 supported in the hole 53, is moved upward in the direction D.

When the boss portion 38 of the second clutch member 36 rotates in a direction K, the catching force exerted by the convex portion 34 of the first clutch member 3 at the position d is reduced to permit the third clutch member 31, first clutch member 32 and the second clutch member 36 (which have been integrated as described above) to be disengaged from each other, which disables the boss portion 38 of the second clutch member 36 from transmitting its rotary motion to the pin 39. In this condition, when the side surface 42 of the first swing member 4 pushes the projection 52 of the second swing member 5, the vertical swinging arm 5; turns about the knife swinging arm shaft 9 in the direction C so that the upper knife 20 fixedly mounted on the upper-knife mounting shaft 8 is moved downward in the direction C.

As described above, the clutch means 3 is a kind of one-way clutch mechanism for lifting the upper knife 20 only in the direction J, and is engaged when only a small force sufficient to lift the upper knife 20 is required. When the upper knife 20 moves downward in the direction K it requires a large amount of force to effect cutting of the cloth, so the one-way clutch or clutch means 3 is disengaged. Since the side surface 42 of the first swing member 4 transmits the larger force required for cutting to the projection 52 of the second swing member 5 with the clutch means 3 disengaged, the clutch means 3 has excellent durability.

When the end 64 of the upper-knife releasing lever 6 is moved downward to the position 64' indicated by the phantom line in FIG. 6, a front end 65 of the lever 6 turns about the pin 62 and moves to a position 65' indicated by the phantom line, so that the front end 65 engages the outer peripheral surface of the first clutch member 32 to cause the first clutch member 32 to turn about the pin 39 in a direction L. At this time, against a reverse force exerted by the spring 37 on the first clutch member 32 in a direction M, the front end 65 of the upper-knife releasing lever 6 is maintained in the position 65' under the influence of the force exerted by the spring 63.

When the first clutch member 32 moves in the direction L, a clearance is produced between the boss portion 38 of the second clutch member 36 and the convex portion 34 of the first clutch member 32 to disengage the clutch means 3 so that the swing motion of the first swing member 4 is not transmitted to the second swing member 5.

With the clutch means 3 disengaged, the side surface 42 of the first swing member 4 moves the projection 52 of the second swing member 5 to cause the upper knife to move downward to a rest position in which the upper knife 20 acts as a cloth guide.

Now, the action of the knife drive mechanism of the sewing machine of the present invention will be described.

(1) When the knife is operated

Rotary motion of the drive shaft 10 is converted into a horizontal swing motion through the eccentric cam 11, and then transmitted to the first swing member 4 through the knife drive rod 12 so that the first swing member 4 swings substantially horizontally. Since the outer peripheral surface of the boss portion 38 of the second clutch member 36, fixed to the first clutch member 4, is sandwiched between the third clutch member fixed to the second swing member 5 and the convex portion 34 of the first clutch member 32, all of the second clutch 36 member (which is fixed to the first swing member 4), third clutch member 31, first clutch member 32, and the projection 52 of the second swing member 5 are swung. At this time, since the second swing member 5 performs an arcuate circular motion around the knife swinging arm shaft 9, the vertical swing arm 51 swings substantially vertically so that the upper knife 20, fixed to the upper-knife mounting shaft 8 passing through the hole 53 of this vertical swing arm 51, is also swung in a substantially vertical direction to effect the up-and-down motion of the upper knife 20. Such up-and-down motion is restricted by upper-knife guide arm 74 having the pin 73 which slidably moves up and down in the elongated hole 72 of the upper-knife guide plate 71, so that a lower limit of the upper knife 20 motion is defined as a position in which the upper knife 20 acts as a cloth guide, and the up-and-down motion of the upper knife 20 becomes closer to a vertical linear motion.

In addition, when the first swing member 4 effects its horizontal swing motion to have its side surface 42 urge the projection 52 of the second swing member 5, the vertical swing arm 51 of the second swing member 5 moves downward so that the upper knife 20 moves downward to effect the cutting operation of the cloth with a large amount of cutting force.

As shown in FIG. 4(*a*), when the upper knife 20 is operated, the upper-knife releasing lever 6 is urged toward the knife releasing mount 61 under the influence of a tensile force which is exerted by the spring 63 so as to be directed downward, so that the lever 6 does not act on the first clutch member 32. At this time, the first clutch member 32 is energized by the clutch-member energizing spring 37 so that the outer peripheral surface of the boss portion 38 of the second clutch member 36 is sandwiched between the convex portion 34 of the first clutch member 32 and the third clutch member 31.

Although an upward motion of the upper knife 20 is a reverse action of a downward motion of the same 20, in contrast with the large force of the downward motion of the upper knife 20, the upward motion of the knife 20 is effected with a small force transmitted through the clutch means 3.

(2) When the knife is released

Even when the drive shaft 10 is in motion, when the upper-knife releasing lever 6 is moved downward as shown in FIG. 4(*b*), the lever 6 is held by the upper-knife releasing lever spring 63 in a position where the end 65 of the upper-knife releasing lever 6 presses the first clutch member 32. At this time, the first clutch member 32 is displaced against the tensile force exerted by the clutch-member energizing spring 37 to permit the outer peripheral surface of the boss portion 38 of the second clutch member 36 to be free from the convex portion 34 of the first clutch member 32. Consequently, even when the first swing member 4 swings horizontally to drive the second clutch member 36 fixed thereto, the second swing member 5 ceases motion so that the side surface 42 of the first swing member 4 drives the projection 52 of the second swing member 5, whereby the vertical swing arm 51 of the second swing member 5 is moved downward to move the upper knife 20 to its rest position in which the knife 20 acts as a cloth guide, as set by the upper-knife positioning means 7.

(3) When the knife is operated again

The outer peripheral surface of the boss portion 38 of the second clutch member 36 is sandwiched between the third clutch member 31 and the projection 34 of the first clutch member 32 when the end 64 of the upper-knife releasing lever 6 is moved upward. When the boss portion 38 is turned in the direction J, the above-mentioned catching action of the clutch means 3 ensures that the force is transmitted from the first swing member 4 to the second swing member 5, so that the upper knife 20 is moved upward in the up-and-down cutting motion.

In addition to the above-described embodiment of the present invention, other embodiments of the present invention include, for example, a preferred embodiment in which the clutch means 3 includes: a plurality of teeth provided in the outer peripheral surface of the boss portion of the second clutch member fixed to the first clutch member 4; a pawl portion provided in the first clutch member connected with the second swing member 5, the pawl portion engaging the teeth of the second clutch member in operation; a clutch-member energizing spring acting as an energizing means for urging the first clutch member to a position in which the pawl portion of the first clutch member engages the teeth of the second clutch member; and an upper-knife releasing lever releasing the energizing force exerted by the energizing spring.

As is clear from the description, it is possible for the knife drive mechanism of the sewing machine according to the present invention to effect engagement/disengagement of the clutch means even during the stitching operation.

Further, when the clutch means is disengaged to disconnect the motion of the upper knife from its drive means, since the first swing member continuously swings, the side surface of the first swing member drives the projection of the second swing member to bring the upper knife to rest in its lower position. Consequently, by the actions of the guide member and the pin engaged in its vertically elongated hole, when the cutting of the cloth is not in progress, the upper knife itself is so positioned as to act as a cloth-feed guide for preventing the misalignment of the cloth or breakage of the sewing needle or upper or lower looper.

What is claimed is:

1. A knife drive mechanism for a sewing machine comprising: a first drive means for converting rotation of a drive shaft into a swinging motion; upper and lower cooperating knives for cutting a cloth with a scissoring action; and upper knife second drive means for converting said swinging motion into an up-and-down driving motion for said upper knife, said upper knife second drive means comprising:

a shaft pivotally mounted on a main frame of the sewing machine;

first and second swing members, said first swing member being provided with a horizontally swingable arm which is horizontally swung by said first drive means, said second swing member being provided with a vertically swingable arm which is connected to said upper knife and which converts the horizontal swing of said horizontally swingable arm to up-and-down driving motion; and clutch means interposed between said first and second swing members for selectively transmitting said horizontal swing to said second swing member.

2. The knife drive mechanism of claim 1, wherein:

said second swing member has a projection abutting against a side surface of said first swing member, said side surface facing the direction in which said first swing member is swung whereby, when said first swing member is swung said second swing member is pivoted to impart said up-and-down driving motion.

3. The knife drive mechanism of claim 1, wherein said clutch means comprises:

a clutch member which is connected to said second swing member and movable between an engaged position in which said clutch member is engaged with said first swing member and a disengaged position in which said clutch member is disengaged from said first swing member;

energizing means for energizing said clutch member to assume said engaged position; and an upper-knife releasing lever for moving said clutch member to said disengaged position against the action of said energizing means.

4. The knife drive mechanism of claim 3, wherein said energizing means is a spring.

5. The knife drive mechanism of claim 1, wherein said upper-knife drive means further comprises:

an upper-knife mounting shaft to which is fixedly mounted said upper knife and which is slidably supported by said second swing member; and means for turning said upper-knife mounting shaft, responsive to said up-and-down driving motion of said second swing member, to forcibly move said upper knife toward said lower knife for cutting cloth in cooperation with said lower knife.

6. The knife drive mechanism of claim 1 wherein said upper knife drive means further comprises:

limit means for defining upper and lower limits for movement of said upper-knife.

7. The knife drive mechanism of claim 6, wherein said limit means comprises:

a first guide member having an elongated hole which extends vertically between upper and lower ends, said first guide member being fixed to the main frame of the sewing machine; and a second guide member fixed to said upper knife for movement therewith and having a pin projecting therefrom into said elongated hole of said first guide member, whereby said upper and lower ends of said elongated hole define said upper and lower limits of movement of said upper knife.

* * * * *

UNITED STATES PATENT AND TRADEMARK OFFICE

CERTIFICATE OF CORRECTION

PATENT NO. : 5,289,789

DATED : March 1, 1994

INVENTOR(S) : Kouichi SAKUMA

It is certified that error appears in the above-indentified patent and that said Letters Patent is hereby corrected as shown below:

Col. 3, line 57, delete "describe" insert --described--.

Col. 7, line 19, delete "3" insert --32--; and line 27, delete "5" (second instance) insert --51--.

Signed and Sealed this

Fourth Day of October, 1994

*Attest:*

*Attesting Officer*

BRUCE LEHMAN

*Commissioner of Patents and Trademarks*